US005735512A

United States Patent [19]

Waddell

[11] Patent Number: 5,735,512

[45] Date of Patent: Apr. 7, 1998

[54] PORTABLE LEVELING VACUUM TOOL

[75] Inventor: John L. Waddell, Redmond, Wash.

[73] Assignee: Northwest Product Development, L.L.C., Fall City, Wash.

[21] Appl. No.: 514,107

[22] Filed: Aug. 11, 1995

[51] Int. Cl.[6] ..... B25B 11/00

[52] U.S. Cl. ..... 269/21

[58] Field of Search ..... 269/21, 35, 37, 269/40, 43, 45, 46, 55, 58, 59, 74, 70, 99, 100, 101, 1, 69, 73, 2

[56] References Cited

U.S. PATENT DOCUMENTS

| | | | |
|---|---|---|---|
| 904,679 | 11/1908 | Bruton | 269/21 |
| 2,311,525 | 2/1943 | Ebbs | 269/286 |
| 3,207,503 | 9/1965 | Clover, Jr. et al. | 269/21 |
| 3,460,822 | 8/1969 | Link | 269/21 |
| 3,484,093 | 12/1969 | Mermelstein | 269/21 |
| 3,804,397 | 4/1974 | Neumann | 269/21 |
| 3,964,710 | 6/1976 | Conroy | 269/21 |
| 4,088,312 | 5/1978 | Frosch et al. | 269/21 |
| 4,291,866 | 9/1981 | Petersen | 269/1 |
| 4,391,511 | 7/1983 | Akiyama et al. | 355/40 |
| 4,566,325 | 1/1986 | Rante | 269/73 |
| 4,723,766 | 2/1988 | Beeding | 269/21 |
| 4,792,129 | 12/1988 | LePrevost, Jr. | 269/46 |
| 4,919,384 | 4/1990 | Grimberg | 269/1 |
| 5,042,772 | 8/1991 | Madjeski | 269/43 |
| 5,083,758 | 1/1992 | Duke | 269/21 |
| 5,135,207 | 8/1992 | Bleaney | 269/21 |
| 5,244,193 | 9/1993 | Hehr | 269/99 |
| 5,246,331 | 9/1993 | Hallahan et al. | 269/69 |

FOREIGN PATENT DOCUMENTS

| | | |
|---|---|---|
| 0 490 746 A1 | 6/1992 | European Pat. Off. . |
| 33 16 980 A1 | 11/1984 | Germany . |
| 753646 | 8/1980 | U.S.S.R. . |

*Primary Examiner*—Robert C. Watson
*Attorney, Agent, or Firm*—Seed and Berry LLP

[57] ABSTRACT

A portable leveling vacuum tool to align a substantially flat top surface of a plurality of workpieces in a coplanar orientation. The vacuum tool includes a pair of parallel frame rails spaced apart from each other to define an intermediate area therebetween. The frame rails have substantially flat, coplanar bottom surfaces that define a planar reference surface against which the top surfaces of the workpieces are positioned. One or more vacuum cup assemblies are movably mounted to the frame rails using a support plate adjustably movable along the length of the frame rails to separably retain the frame rails adjacent to one another and allow selective longitudinal positioning of the vacuum cup assemblies along the frame rails. The vacuum cup assemblies each have a vacuum cup positioned in the intermediate area and adapted to engage a top surface of a workpiece to hold the workpiece against the reference surface. The vacuum cup is movable in two directions relative to the support plate, and moveable in three dimensions relative to the frame rails. Stiffening members are connectable to the frame rails to inhibit flexing of the frame rails.

30 Claims, 7 Drawing Sheets

PORTABLE LEVELING VACUUM TOOL

TECHNICAL FIELD

The present invention relates to an article holding device, and more particularly to a portable vacuum tool.

BACKGROUND OF THE INVENTION

The process of installing countertops, table tops, and sink tops, using tiles or slabs of ceramic, glass, marble, granite, or other fine stone, is typically very time consuming and labor intensive. The artisan must be very careful during installation of each tile or slab to correctly position it relative to other tiles or slabs and relative to a support subsurface before the tile or slab is permanently adhered to the support subsurface. When laying tile, the artisan must also carefully select which tiles are adjacent to each other. When adjacent tiles of different thicknesses are individually set into an adhesive on the support subsurface, the adjacent top surfaces of the tiles will not be coplanar, thereby resulting in an uneven tile surface. Similar care must be taken with adhering adjacent slabs of countertop material such as marble, granite, or Corian to avoid uneven joints between the adjacent slabs.

Accordingly, a slow drying adhesive must be used while laying individual tiles or adhering adjacent slabs in a conventional manner to allow the artisan to make height adjustments before the adhesive sets. In addition, the tiles or slabs must be protected from inadvertent movement for a long period of time until the adhesive has sufficiently set. As a result, a construction or reconstruction project must allot a large block of time for tile work, countertop work, and the like, thereby adding to the ultimate cost of the project.

When slab countertops are cut, for example, to create a hole to receive a sink, the hole is typically cut after the slab has been secured to the counter support subsurface. If the countertop is marble or granite, the cutting process is very labor intensive. At least one person is required to support the material being cut out as the cuts are completed to prevent the portion being cut out from sagging and breaking before all of the cuts are completed. This process is also very time-consuming, and multiple people are required, thereby adding to the cost of the process.

Presently there is not an adjustable, portable, vacuum workpiece holding device that is suitable for holding, positioning, leveling and aligning tile and slab workpieces before and during installation to create coplanar top surfaces and for supporting larger slabs or sheet workpieces during transportation, installation, or machining of the workpiece at the installation site.

Holding devices utilizing vacuum holding members to retain a workpiece in a desired position are used in manufacturing processes because of the ease and speed of retaining workpieces in a selected position, and because of the speed in which the workpieces may be released. However, such vacuum holding devices are primarily large, permanent fixtures used in manufacturing plants. Other conventional vacuum holding devices include one or more vacuum cups that extend through apertures in a plate structure to hold a workpiece against the plate.

These conventional vacuum holding devices are not sufficiently adjustable or portable to be effectively and efficiently used for a wide variety of projects, such as installing tiles or slabs of marble, granite, glass, or the like, at remote installation sites. The conventional vacuum holding devices are not portable units that provide a leveling system which aligns top surfaces of a plurality of workpieces in a coplanar orientation while adhering the bottoms of the workpieces to a support subsurface at the installation site. The conventional vacuum holding devices also do not provide sufficient adjustability of the position of the vacuum cups relative to the workpieces being supported so as to allow the vacuum holding devices to be used with a wide range of workpieces having different shapes and sizes.

SUMMARY OF THE INVENTION

The present invention is directed toward a portable vacuum tool for use with one or more workpieces that solves the above-identified drawbacks of conventional devices. In a preferred embodiment of the invention, the portable vacuum tool includes a pair of elongated frame rails in spaced-apart parallel relation to each other. A vacuum cup assembly is movably mounted to the frame rails and positionable to engage a top surface of a selected workpiece to hold it against the frame rails. In an alternate embodiment, the portable vacuum tool includes a plurality of vacuum cup assemblies mounted to the frame rails and adapted to securely retain a plurality of workpieces.

The frame rails have substantially flat, elongated bottom surfaces. The frame rail bottom surfaces are spaced apart in a coplanar relation for engagement with the top surfaces of the workpieces to position the top surfaces in a coplanar relation. Each of the vacuum cup assemblies includes a support plate that is adjustably attached to the frame rails. A vacuum cup is supported by the support plate and positioned between the frame rails. The vacuum cup is movable toward and away from the support plate, and the workpieces. The vacuum cup assembly is movable longitudinally relative to the frame rails to provide adjustability.

The vacuum cup assembly also includes a vacuum pump that is connected to the vacuum cup to create suction between the vacuum cup and the top surface of an engaged workpiece. In one embodiment, the vacuum pump is a manual pump having a tubular body that is coupled to the vacuum cup at one end and that extends upwardly through the support plate. The vacuum pump also includes a plunger that is slidably disposed within the tubular body. The plunger has indicia thereon that allows a user to visually determine when suction is created between the vacuum cup and the workpiece. A handle is adjustably received on the tubular body, and an upper portion of the plunger extends through an aperture in the handle to provide a user with access to the plunger while holding onto the vacuum cup assembly.

The frame rails of the preferred portable vacuum tool are each comprised of a plurality of interconnected, axially extending frame rail sections. The portable leveling vacuum assembly also includes stiffening members removably connectable to the frame rails to stiffen the frame rails and inhibit their deflection.

In one embodiment, the portable vacuum tool includes multiple sets of frame rails, each set having at least one vacuum cup assembly mounted thereon. Transverse bridging members are removably attached to the sets of frame rails to interconnect the sets, thereby forming an array of frame rails and vacuum cup assemblies.

DETAILED DESCRIPTION OF THE INVENTION

Figure 1:
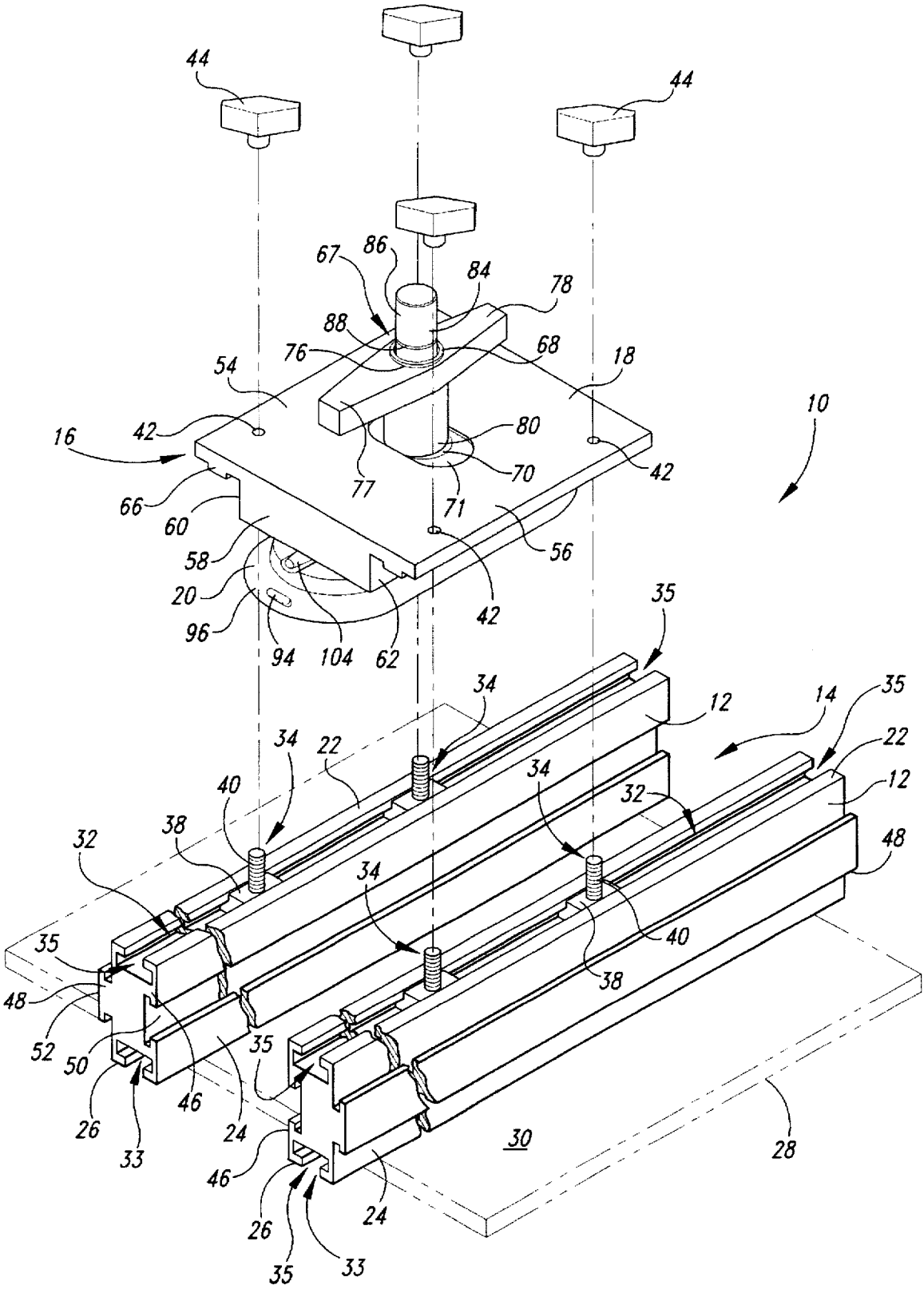
FIG. 1 is a fragmentary, exploded isometric view of a portable leveling vacuum tool in accordance with the present invention, showing a single vacuum cup assembly and a pair of frame rails, with a workpiece shown in phantom lines.

A portable leveling vacuum tool 10 in accordance with the present invention is illustrated in FIG. 1. The vacuum tool 10 includes a pair of substantially parallel arranged, elongated left and right frame rails 12 spaced apart from each other to define an intermediate area 14 therebetween. A vacuum cup assembly 16 is adjustably connected to the frame rails 12 such that the vacuum cup assembly is longitudinally movable along the length of the frame rails. The vacuum cup assembly 16 includes a support plate 18, which is releasably secured to a top portion 22 of each of the frame rails 12, and a suction or vacuum cup 20 that is supported by the support plate and positioned between the frame rails in the intermediate area 14. The vacuum cup assembly 16 is longitudinally movable along the frame rails 12 so as to position the vacuum cup 20 at substantially any desired position along the length of the frame rails.

The vacuum cup 20 is adapted to releasably engage a tile, slab, sheet or other generally rigid workpiece 28, illustrated in phantom lines in FIG. 1, and securely hold the workpiece against a bottom portion 24 of each of the frame rails 12. The illustrated workpiece 28 has a substantially flat top surface 30 that is engaged by the vacuum cup 20, and pulled upward against the bottom portions 24 of the frame rails 12. The bottom portions 24 of the frame rails 12 have flat, coplanar reference surfaces 26 which engage the flat top surface of the workpiece to securely and releasably hold the workpiece during use of the vacuum tool 10. When the workpiece is securely retained against the frame rails 12, the flat top surface 30 of the workpiece is substantially coplanar with the reference surfaces 26 of the frame rails.

As noted, the workpiece 28 with which the tool is used may be a slab of fine stone such as marble, granite, or the like, used for floor, wall, or countertop surfaces in homes or in commercial buildings. The workpieces may also be a ceramic tile, glass block, sheet of glass, sheet of plastic, wood block, sheet of wood, and the like. When the vacuum cup 20 is securely attached to the workpiece 28, the workpiece and the vacuum tool 10 are movable as a unit, for example, to a counter subsurface at a remote installation location. The vacuum tool 10 may be lifted manually by a user with the workpiece attached. As will be described below, the reference surfaces 26 of the frame rails 12 may be positioned partially on a reference member to establish a desired height for the top surface 30 of the workpiece 28 above the counter subsurface, thereby quickly and easily aligning the top surface of the workpiece so it is coplanar with the reference member of the counter subsurface and other workpieces already installed. The workpiece 28 is fixedly attached to the counter subsurface with the vacuum tool 10 still attached to the workpiece, such that, when the adhesive used to attach the workpiece to the counter subsurface dries and the vacuum tool is removed from the workpiece, the countertop formed by the workpiece and similarly installed other workpieces will have a flat and coplanar upper surface.

Figure 3:
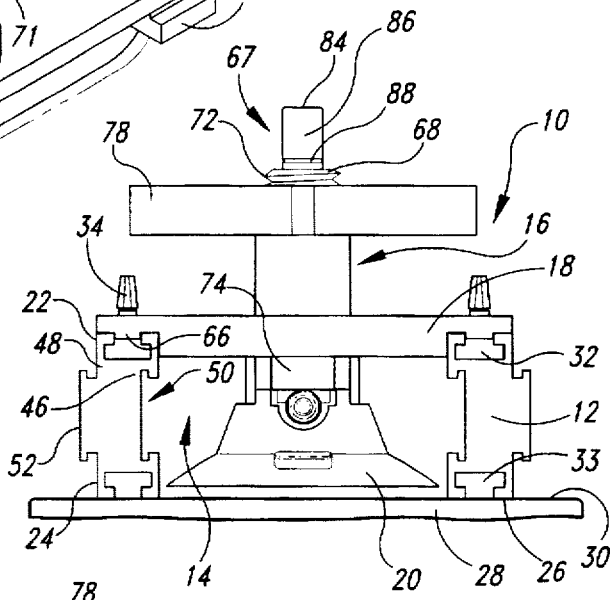
FIG. 3 is an enlarged, front elevation view of the vacuum tool of FIG. 1 with the workpiece shown in solid lines and the vacuum cup shown in a retracted position before suction is created between the vacuum cup and the workpiece.

As best seen in FIGS. 1 and 3, each of the frame rails 12 has upper and lower elongated, T-shaped keyways 32 and 33, respectively, extending longitudinally along its top and bottom portions 22 and 24, respectively. The frame rails 12 are identical and each is symmetric about an imaginary center plane extending longitudinally along a center longitudinal axis of the frame rail and parallel to the bottom reference surface 26. As such, the top and bottom portions 22 and 24 and the upper and lower keyways 32 and 33 are substantially identical. Since all frame rails 12 have an identical cross-sectional shape, the frame rails are interchangeable and any frame rail can be used as the left or right side frame rail. By using symmetrical frame rails 12, a user can quickly assemble the vacuum tool 10 without having to differentiate between different shaped left side and right side frame rails.

Each of the frame rails 12 has opposing inner and outer sidewall portions 46 and 48, respectively, extending between its top and bottom portions 22 and 24. The inner portion 46 has a vertically oriented, T-shaped keyway 50 therein that extends longitudinally along the length of the frame rail 12. The outer portion 48 has a similarly sized and oriented T-shaped key member 52 extending longitudinally along the length of the frame rail 12, directly opposite the inner keyway 50. The key member 52 has a cross-section that is slightly smaller than the cross-section of the inner keyway 50, so the key member 52 of a third frame rail can be slidably positioned within the inner keyway 50 of the other frame rail. This securely retains two frame rails together in a side-by-side arrangement with the reference surfaces 26 of the two frame rails being coplanar. As will be described below, the third frame rail can be used to add rigidity to the frame raids 12 of the vacuum tool 10 or to connect two vacuum tools together.

As best seen in FIG. 1, the upper and lower keyways 32 and 33 each have open ends 35 at both outer ends of the frame rail 12. The upper keyway 32 slidably receives rectangular heads 38 of fastening members 34 that are used to engage and retain the support plate 18 in a selected longitudinal position against the top portion 22 of the frame rail 12. The preferred fastening member 34 has a T-shaped nut as the head 38 with a cross-sectional shape and size that generally corresponds to the shape and size of the upper keyway 32. As such, the head 38 can only be removed from the upper keyway by sliding the head out one of the open ends 35 of the upper keyway.

Each fastening member 34 also includes a threaded shaft 40 that is screwed into the head 38. The threaded shaft 40 extends upwardly out a leg portion of the upper keyway 32 within which disposed and through a fastener aperture 42 in the support plate 18. A winged cap nut 44 is screwed onto the portion of the threaded shaft 40 extending above the support plate and is releasably tightened against the support plate 18, thereby securely fastening the support plate 18 against the top portion 22 of the respective frame rail 12 and preventing its longitudinal movement along the frame rail during use of the vacuum tool 10. Each of the cap nuts 44 is sized to be hand tightened by the user for quick and easy adjustment by the user. Four fastening members 34 retain the support plate 18 of the vacuum cup assembly 16 to the two frame rails 12, with the heads 38 of two fastening members 34 positioned in the upper keyway 32 of each frame rail 12.

When the cap nuts 44 of the fastening members 34 are loosened, the vacuum cup assembly 16 is easily and quickly slidable to any selected longitudinal position along the frame rails 12, making the position of the vacuum cup assembly infinitely variable by the user of the vacuum tool 10. After the vacuum cup assembly 16 is in the selected position, the cap nuts 44 are tightened, thereby locking the support plate 18 and the vacuum cup assembly in the selected position. In use, the vacuum cup assembly 16 is usually moved and locked in the selected position before the vacuum cup 20 is secured to the workpiece 28.

As best seen in FIG. 1, the support plate 18 spans across the intermediate area 14 between the two frame rails 12. The support plate 18 has left and right side portions 54 and 56, respectively, that extend outwardly away from a center portion 58 and overlay and engage the top portions 22 of the frame rails 12. The left and right side portions 54 and 56 each have a pair of the fastener apertures 42 extending therethrough and positioned to receive the threaded shafts 40 of the two fastening members 34 received by the corresponding left or right frame rail. The center portion 58 includes left and right sidewalls 60 and 62, respectively, that are parallel to the frame rails 12 and extend below the left and right side portions 54 and 56 to positions immediately adjacent to the inner sidewall portions 46 of the frame rails 12. Accordingly, the left and right sidewalls 60 and 62 facilitate alignment of the support plate 18 of the vacuum cup assembly 16 on the frame rails 12 so the fastener apertures 42 are properly aligned with the threaded shafts 40 of the fastening members 34.

As best seen in FIGS. 1 and 3, alignment of the support plate 18 on the frame rails 12 is also facilitated by lower alignment tabs 66 extending the length of the support plate that project downwardly from the left and right side portions 54 and 56 and partially into the upper keyways 32 of the left and right frame rails. The alignment tabs 66 and the left and right side walls 60 and 62 allow the user to quickly and easily position the support plate 18 atop the frame rails 12 with the proper orientation on assembly of the vacuum tool 10.

Figure 2:
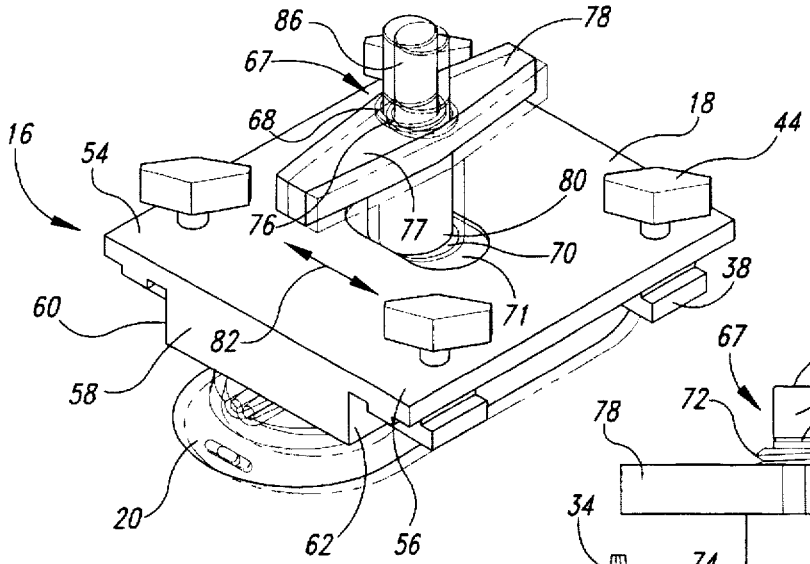
FIG. 2 is an enlarged, isometric view of the vacuum cup assembly of FIG. 1 with a vacuum cup being shown in solid lines in a first position, and shown in phantom lines in a second laterally displayed position.

As best seen in FIGS. 1 and 2, the center portion 58 of the support plate 18 includes a recessed area 71 having a laterally extending elongated aperture 70 therethrough. The vacuum cup assembly 16 has a manual vacuum pump 67 having a tubular pump body 68 that extends from a position below the support plate where it is attached to the vacuum cup 20 (see FIG. 3), upwardly through the elongated aperture 70 to a position above the support plate. A handle 78 is positioned above the support plate 18 and has an internally threaded central aperture 76 that threadably receives a threaded upper portion 72 of the pump body 68. A lower portion 74 of the pump body 68 is larger than the elongated aperture 70 to limit upward movement of the pump body relative to the support plate 18. The handle 78 is adjustably rotatable on the pump body 68 to raise and lower the vacuum cup 20 relative to the support plate 18.

A lower end 80 of the handle 78 has a diameter that is larger than the width of the elongated aperture 70, and smaller than the width of the recessed area 71. The lower end 80 engages the support plate 18 in the recessed area 71 and is blocked from moving downward through the elongated aperture 70. Rotation of the handle 78 in the clockwise direction about the threaded upper portion 72 of the pump body 68, when looking down on the handle from above, causes the pump body to be pulled upwardly relative to the support plate 18, thereby moving the vacuum cup 20 upwardly relative to the frame rails 12. Conversely, counterclockwise rotation of the handle 78 about the pump body 68, when looking down on the handle from above, causes the pump body to move downwardly relative to the support body 18, thereby moving the vacuum cup 20 downwardly relative to the frame rails 12. The weight of the vacuum pump 67 urges the vacuum cup 20 downward.

When the vacuum cup 20 engages the top surface 30 of the workpiece 28 with vacuum applied, and then the handle 78 is rotated about the pump body 68 in the clockwise direction, the workpiece is drawn upwardly to place the top surface of the workpiece in firm engagement with the reference surfaces 26 of the frame rails 12.

In addition to being movable vertically relative to the support plate 18 and to the frame rails 12, the vacuum cup 20 is also movable laterally relative to the support plate in a direction transverse to the frame rails. As best seen in FIG. 2, the pump body 68 is movable laterally along the length of the elongated aperture 70 between a left position, shown in solid lines, and a right position, shown in phantom lines. The lateral movement of the pump body 68 simultaneously moves the vacuum cup 20 and the handle 78 relative to the support plate 18 between the left and right positions. The laterally movable vacuum cup 20 enables the user to adjust the lateral position of the workpiece 28 relative to the frame rails 12 after the vacuum cup has been attached to the workpiece and before the handle 78 is tightened to secure the workpiece against the bottom reference surface 26 of the frame rails. The vacuum cup 20 can also be moved laterally to a selected lateral position between the left and right positions before the vacuum cup is pressed into engagement with the workpiece 28 to adjust the lateral position at which the vacuum cup engages the workpiece.

Accordingly, the vacuum cup 20 is movable in two dimensions, laterally and vertically, relative to the support plate 18, and the vacuum cup is movable in three dimensions, vertically, laterally, and longitudinally, relative to the frame rails. This three-dimensional movement of the vacuum cup 20 provides for a highly adjustable vacuum assembly 10 that is usable with a wide range of workpieces having different shapes and sizes.

Figure 5:
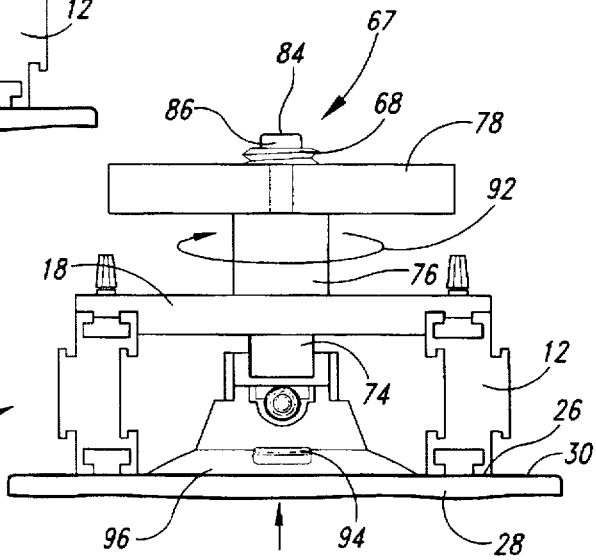
FIG. 5 is a front elevation view of the vacuum tool of FIG. 4, with the handle in a lowered position, and the plunger in a lowered position indicating suction has been created between the vacuum cup and the workpiece.

In the illustrated embodiment, the pump body 68 has an interior area that is connected to a conventional valved passageway (not shown) extending through the lower portion 74 of the pump body to the vacuum cup 20. As best seen in FIGS. 1, 3 and 5, the vacuum pump 67 includes a plunger 86 that is slidably and sealably positioned in the pump body 68 and is movable between an upper position (FIG. 3) and a lower position (FIG. 5) to draw air out of the vacuum cup 20 through the valved passageway when the vacuum cup engages a workpiece 28. The plunger 86 is spring biased toward the upper position. The plunger 86 has a top portion 84 that extends out of the pump body 68 and is accessible to the user while holding the handle 78. The vacuum pump 67 is activated to create suctions between the vacuum cup 20 and the workpiece 28 by depressing the plunger 86 and moving it from the upper position to the lower position. As the spring biased plunger 86 returns to the upper position, air is sucked out of the vacuum cup 20, through the valved passageway, and into the pump body 68, thereby creating suction between the vacuum cup 20 and the workpiece 28. When sufficient suction is created to securely retain the workpiece 28 against the vacuum cup, the suction force is greater than the spring biasing force, and the plunger remains in the lower position and will not return to the upper position until the suction is broken.

The top portion 84 of the plunger 86 has a ring marker 88 thereon that is above the pump body 68 and is visible to the user when the plunger is in the upper position, but below the pump body upper end and not visible when the plunger 86 is in the lower position. When visible, the marker 88 indicates to the user that sufficient suction has not yet been created between the vacuum cup 20 and the workpiece 28 to securely retain the vacuum cup on the workpiece. In the illustrated embodiment, the marker 88 is a colored band around the plunger 86 that allows the user to quickly and visually determine whether the vacuum cup 20 is securely attached to the workpiece.

Before the user uses the vacuum tool 10, and releasably connects the vacuum cup 20 to the selected workpiece 28, the user adjusts the longitudinal position of the vacuum cup assembly 16 along the frame rails 12 by loosening the cap nuts 44 and sliding the vacuum cup assembly along the frame rails to the desired position. The cap nuts 44 are then tightened to lock the vacuum cup assembly in the desired position to which moved. The user then rotates the handle 78 about the pump body 68 in the clockwise direction, thereby raising the vacuum cup 20 to a retracted position, illustrated in FIG. 3, such that the vacuum cup is located above the bottom reference surfaces 26 of the frame rails 12.

Figure 4:
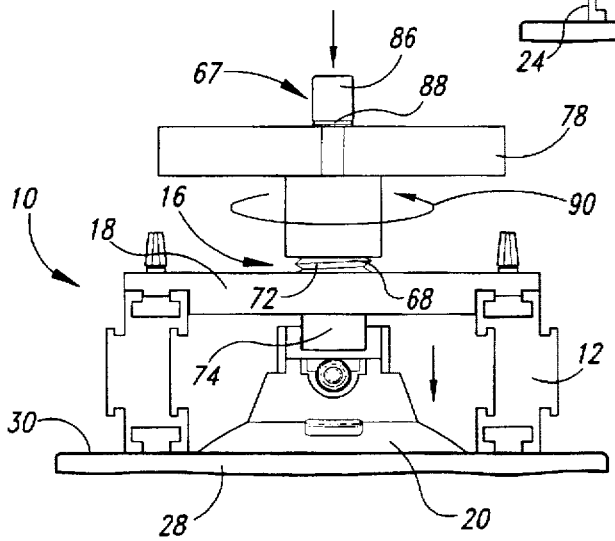
FIG. 4 is a front elevation view of the vacuum tool of FIG. 3 with the vacuum cup engaging the workpiece, with a handle in a raised position and a vacuum pump plunger in a raised position.

The vacuum tool 10 is then used by setting the frame rails 12 onto the top surface 30 of the workpiece 28 at a selected position, with the vacuum cup 20 being in the retracted position, such that the bottom reference surfaces 26 of the frame rails 12 flatly engage the top surface 30. As best seen in FIG. 4, the handle 78 is then rotated about the pump body 68 in the counterclockwise direction illustrated by arrow 90, thereby lowering the pump body 68. The vacuum cup 20 simultaneously moves downwardly with the pump body 68 away from the retracted position to a lowered position whereat the vacuum cup is pressed into sealing engagement with the top surface 30 of the workpiece 28. At this time in the installation process, the plunger 86 is in the upper position with the marker 88 being visible.

With the vacuum cup 20 in the lowered position, the vacuum pump plunger 86 is pumped several times by pressing downward on the plunger to move the plunger into the pump body 68 to generate suction between the vacuum cup and the top surface 30 of the workpiece 28. The plunger 86 is depressed as many times as needed until the suction holds the plunger 86 in the lower position, illustrated in FIG. 5, such that the marker 88 is not visible to the user.

After the suction has been generated, the handle 78 is rotated about the pump body 68 in the clockwise direction, illustrated by the clockwise arrow 92 in FIG. 5, thereby pulling the vacuum cup 20 upwardly toward the retracted position and simultaneously pulling the top surface 30 of the workpiece 28 securely against the bottom reference surfaces 26 of the frame rails 12. The handle 78 is rotated until the vacuum cup can lift the workpiece no further and the top surface 30 of the workpiece 28 is substantially coplanar with the bottom reference surfaces 26.

The vacuum tool 10 is quickly removable from the workpiece 28 by breaking the suction between the vacuum cup 20 and the workpiece and lifting the vacuum tool off of the workpiece. As best seen in FIGS. 1 and 5, the vacuum cup 20 has a releasing tab 94 integrally connected to an outer lip 96 of the vacuum cup. The suction force is broken by lifting or pushing the releasing tab 94 upwardly and toward the handle 78, thereby lifting a portion of the outer lip 96 upwardly out of sealing engagement with the top surface 30 of the workpiece 28 and providing an avenue through which air is drawn into the area between the vacuum cup 20 and the top surface of the workpiece. After the suction has been broken, the handle 78 may be rotated clockwise about the pump body 68 to move the vacuum cup 20 to the retracted position away from the workpiece 28. The vacuum tool 10 is then ready to be attached to another workpiece or to be stored for future use. If desired for compact storage, the vacuum cup assembly 16 can be quickly and easily removed from the frame rails 12 by loosening the cap nuts 44.

As discussed in greater detail below, two, three or more vacuum cup assemblies 16 can be connected to a pair of frame rails 12 with sufficient length to engage and hold two, three or more workpieces 28. Each of the vacuum cup assemblies 16 is releasably secured to a workpiece 28 as discussed above. When the vacuum tool is attached to the one or more workpieces 28, the workpieces and the vacuum tool are movable as a unit. As an example, the vacuum tool 10 may be securely attached to several marble, granite, or other type of fine stone tiles in a stone layer's workshop, and then the vacuum tool with the tiles attached transported as a unit from the workshop to a residence undergoing construction.

Figure 6:
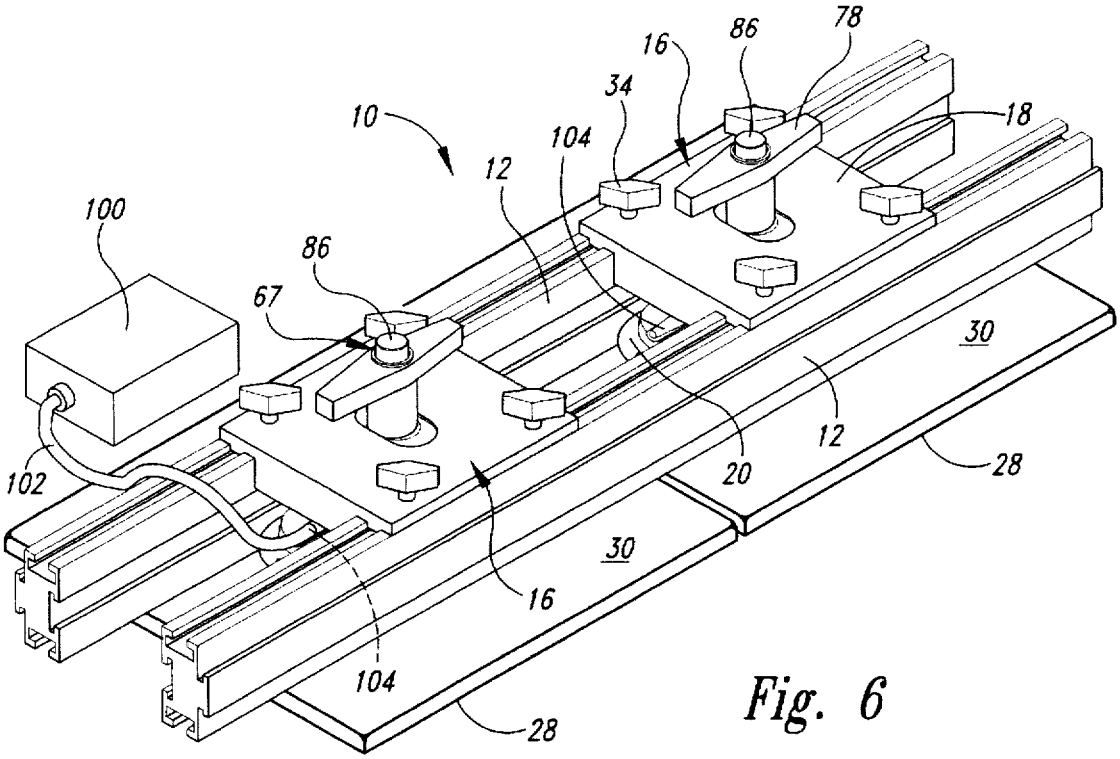
FIG. 6 is a reduced scale, isometric view of the vacuum tool of FIG. 1 showing two vacuum cup assemblies securely retaining two adjacent workpieces against the frame rails, and an electric vacuum pump connected to one of the vacuum cup assemblies.

An alternate embodiment of the vacuum tool 10 is shown in FIG. 6 which includes two vacuum cup assemblies 16 positioned at spaced apart longitudinal positions along a pair of frame rails 12. The vacuum cup assemblies 16 are separated from each other by a selected distance, and each vacuum cup assembly engages and retains one of two separate workpieces 28. The vacuum cup assemblies 16 are longitudinally positioned along the frame rails 12 so that the workpieces 28 are held in a side-by-side relationship with the top surfaces 30 of each workpiece being coplanar with each other and with the bottom reference surfaces 26 of the frame rails.

Figure 7:
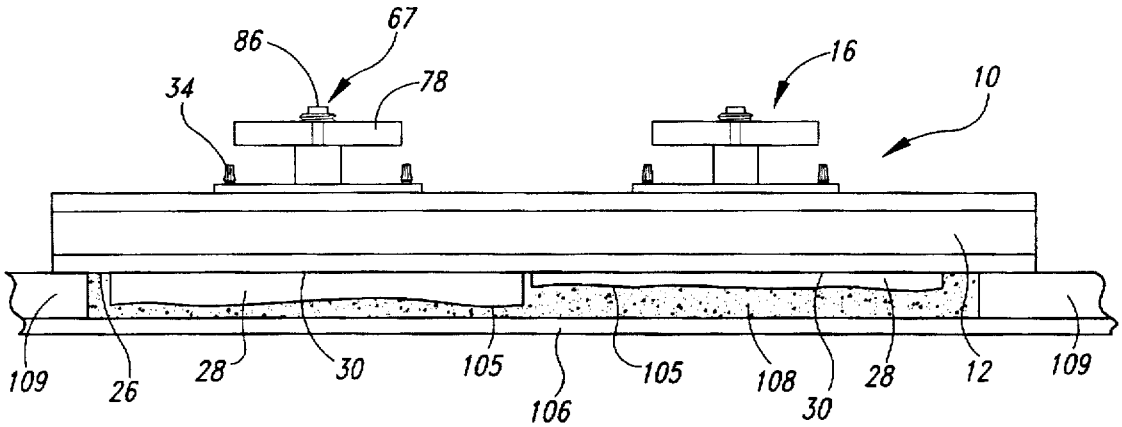
FIG. 7 is a side elevation view of the vacuum tool of FIG. 6 illustrating the retained two workpieces of different thicknesses positioned on a support surface.

The pair of vacuum cup assemblies 16 on the frame rails 12 allow the user to securely retain the workpieces 28 with their edges spaced apart from each other a selected distance while keeping the top surfaces 30 of the workpieces coplanar with each other. Accordingly, the adjacent workpieces 28 retained by the vacuum tool in a coplanar relation are ready to be set onto, as an example, a counter 106, as illustrated in FIG. 7, or another support structure in a layer of adhesive material 108. Because the workpieces 28 are retained in desired positions relative to each other before setting them onto the counter 106, a quick drying adhesive material can be used to adhere the coplanar workpieces to the counter. By using a quick drying adhesive the installation process can be speeded up while producing a planar countertop.

As best seen in FIG. 7, the vacuum tool 10 provides a leveling device that positions the top surfaces 30 of the workpieces 28 coplanar with each other even though their lower surfaces 105 may not be coplanar because each workpiece has a different thickness as commonly is the case with tiles. The frame rails 12 are selected with a sufficient length to extend and overlay reference members 109 used to establish the plane in which the top surfaces 30 of the tile workpieces 28 are to be installed. The reference members 109 may be the edge molding pieces for the counter 106 or the previously finished portions of the counter. As can be seen, the bottom references surfaces 26 of the frame rails 12 span between reference members 109 of the counter and precisely position the top surfaces 30 of the workpieces 28 level with the desired reference plane. The result is a finished countertop having level and coplanar workpiece top surfaces.

By retaining the top surfaces 30 of the workpieces 28 against the bottom reference surfaces 26 of the frame rails 12, the vacuum tool 10 allows workpieces having different thicknesses, as is illustrated in FIG. 7, to be positioned adjacent to each other and installed on a countertop 106 or other support structure in a manner that avoids producing an unlevel finished countertop. The vacuum tool 10 is connected to the top surfaces 30 of workpieces 28 having different thicknesses, and the vacuum tool and workpieces are set onto the countertop 106, with the lower surfaces 105 of the workpieces being pressed into the adhesive material 108. After the adhesive material 108 has set, the vacuum tool 10 is removed by breaking the suction between the vacuum cups 20 and the workpieces, and lifting the vacuum cups off of the workpieces. Accordingly, the workpieces 28 are quickly adhered to the counter 106 with the top surfaces 30 being coplanar with the desired reference plane and hence the other portions of the counter installed and to be installed regardless of the different thicknesses of the workpieces and their uneven lower surfaces.

As best seen in FIG. 6, the vacuum cup assembly 16 of the preferred embodiment has a valved connection port 104 that is in communication with the vacuum cup 20 and connected to the conventional valved passageway (not shown) discussed above. The connection port 104 is adapted for removable connection of a hose 102 of an electric pump 100. If desired, rather than manually operating the plunger 86 of the manual vacuum pump 67, when the vacuum cup 20 is in sealing engagement with the top surface 30 of the workpiece 28 and the electric pump 100 is activated, the electric pump will operated to draw air out of the vacuum cup 20 through the valved passageway and through the connection port 104, thereby generating the suction that securely retains the vacuum cup on the workpiece. The suction created by the electric pump 100 causes the plunger 86 of the manual vacuum pump 67 to be drawn downwardly to the lower position with the marker 88 not visible to the user, thereby indicating sufficient suction has been generated. The hose 102 can then be disconnected from the connection port 104, and the vacuum assembly 16 will maintain the established suction between the vacuum cup 20 and the workpiece 28.

Figure 8:
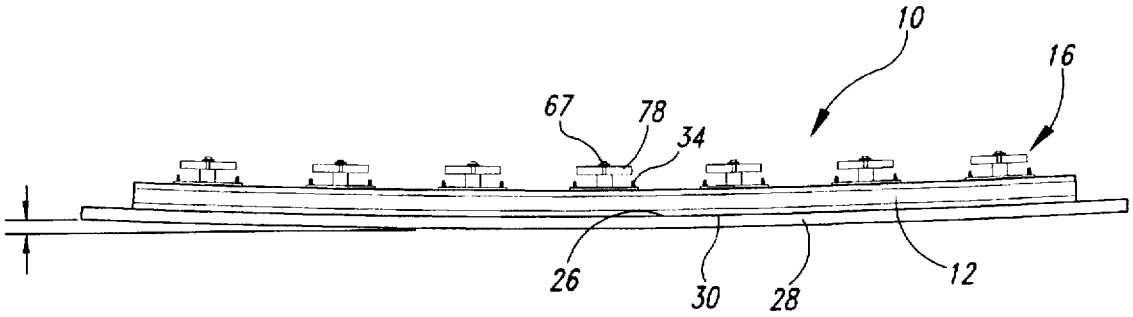
FIG. 8 is a side elevation view of the vacuum tool of the present invention using longer frame rails with multiple vacuum cup assemblies adjustably attached thereto, the frame rails being shown in a deflected position and supporting a slab workpiece.

In an alternate embodiment illustrated in FIG. 8, the frame rails 12 are elongated members, and seven vacuum cup assemblies 16 are connected to and spaced apart along the length of the frame rails. The multiple vacuum cup assemblies 16 are positioned to retain either a single elongated workpiece 28 such as shown in FIG. 8, or seven separate workpieces 28 against the bottom reference surfaces 26 of the frame rails. Each of the frame rails 12 is a generally rigid member having a predetermined degree of flexibility, depending upon the length of the frame rail and material from which the frame rail is constructed. The longer the frame rail 12, the greater the overall flexibility. As an example, a three foot length of the preferred frame rail 12 has a minimum amount of flexibility, such that deflection of the frame rail is substantially negligible. However, a twelve-foot length of frame rail 12 flexes to produce a deflection of up to one inch.

When a floor surface or the like to which tiles or other workpieces are to be adhered is not perfectly planar, the flexibility of the elongated frame rails 12 allows the frame rails to deflect and gently curve to accommodate the curved or otherwise uneven floor surface, while maintaining a generally coplanar relationship between the upper surfaces 30 of immediately adjacent workpieces 28.

Figure 9:
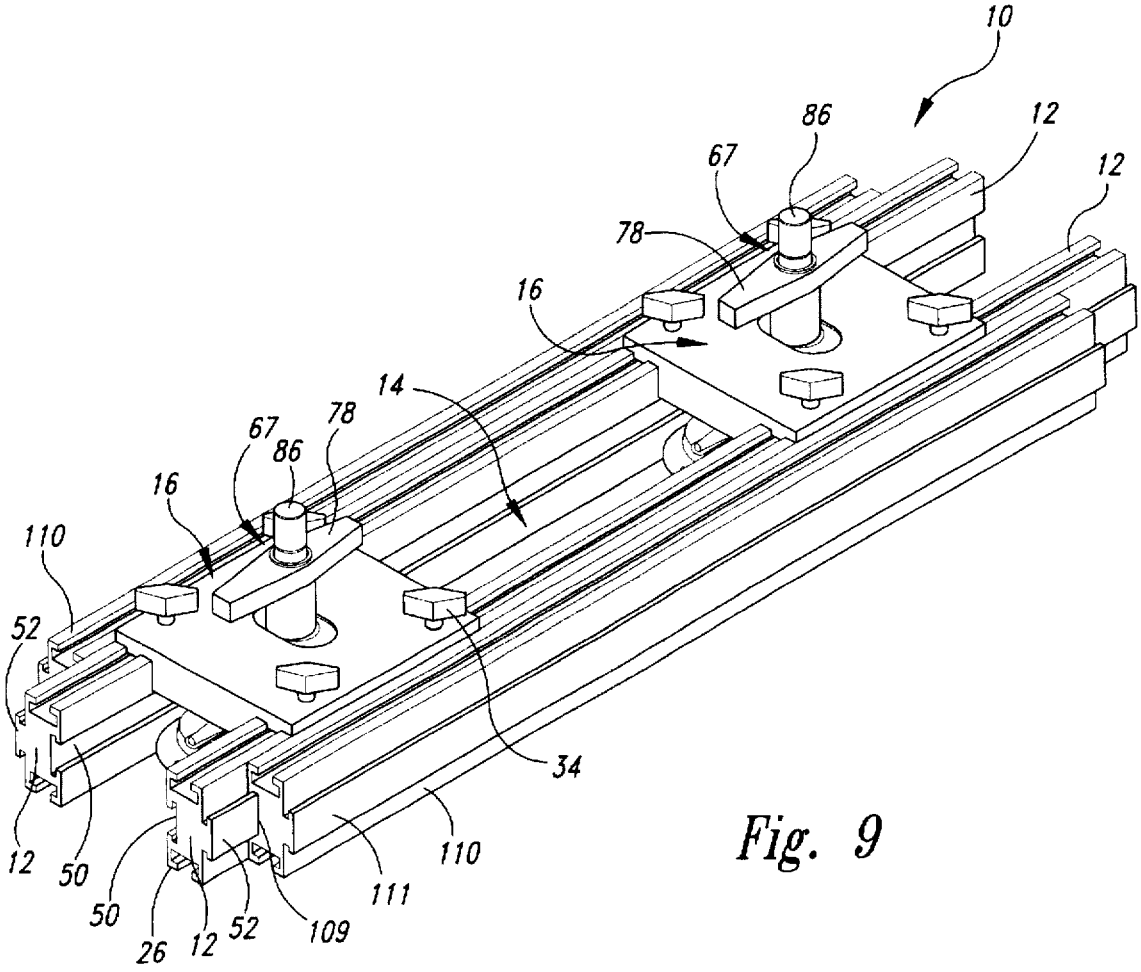
FIG. 9 is an isometric view of the vacuum tool of FIG. 6 with stiffening rails removably attached to opposing sides of the frame rails and with the electric vacuum pump removed.

As best seen in FIG. 9, when it is desired to eliminate or reduce the flexibility of the frame rails 12, stiffening members 110 may be removably attached to one or both of the left and right frame rails 12 of the vacuum tool 10. In such manner the frame rails will remain substantially straight and free of deflection. In the illustrated embodiment, the stiffening member 110 has an identical cross-sectional shape as the frame rails 12 and may itself be a spare frame rail, typically of shorter length. The stiffening member 110 has a keyway 109 on one side, and a corresponding key member 111 protruding from the opposite side thereof. The keyway 109 of the stiffening member 110 is the same size and shape as the keyway 50 of the frame rail 12, and the key member 111 is the same size and shape as the key member 52 of the frame rail so that it is usable as a frame rail when not in use as a stiffening member. The stiffening member 110 is slidably attached to one of the frame rails 12 by aligning the stiffening member parallel with the frame rail to which it is to be attached and aligning an open end of the keyway 109 of the stiffening member with an end of the key member 52 of the frame rail in a tongue-and-groove configuration, and then sliding the stiffening member onto and along the frame rail. The stiffening member 110 is slid to a selected position along the length of the frame rail 12, such as adjacent to one or more of the vacuum cup assemblies 16, to provide the desired additional stiffness to the frame rail in that area.

Although the illustrated embodiment of FIG. 9 has the frame rails 12 positioned with the key members 52 on the outside extending away from each other and the keyways 50 on the inside facing into the intermediate area 14, the frame rails may be oriented such that the key members 52 are on the inside and the keyways 50 are on the outsides of the frame rails. In this alternate configuration, the stiffening members 110 are attached to the frame rails 12 by inserting the key member 111 of the stiffening member into the keyway 50 of the frame rail 12, and sliding the stiffening member along the frame rail to the selected position.

In another alternate embodiment not illustrated, one frame rail may be oriented such that the key member 52 is on the outside extending away from the intermediate area 14, and the key member 52 on the other frame rail is on the inside facing into the intermediate area. In this alternate embodiment, the stiffening member 110 is attached to the frame rail by positioning the stiffening member such that the tongue-and-groove configuration is created between the respective frame rail and the stiffening member so as to slidably position the stiffening member on the frame rail.

Although the preferred embodiment utilizes a stiffening member 110 having the same cross-sectional shape as the frame rails 12 to provide interchangeability between the stiffening members and the frame rails, other stiffening members that removably attach to the frame rails and increase the stiffness of the respective frame rail can be used in accordance with the present invention. The frame rails 12 may be manufactured from plastic, aluminum or any other suitable material having the desired degree of flexibility or stiffness.

Figure 10:
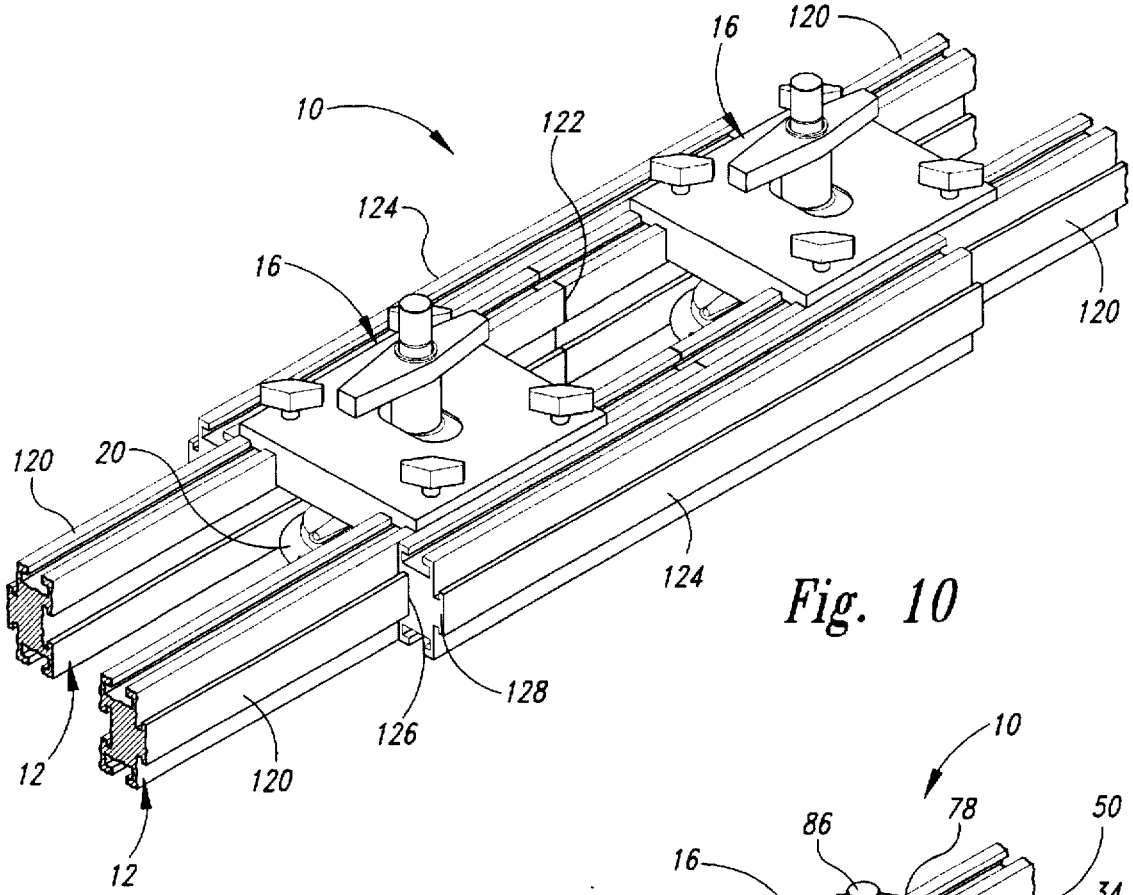
FIG. 10 is a fragmentary, isometric view of two vacuum tools of the present invention with the frame rails of the vacuum tools in end-to-end alignment and interconnected by connecting rails.
Figure 11:
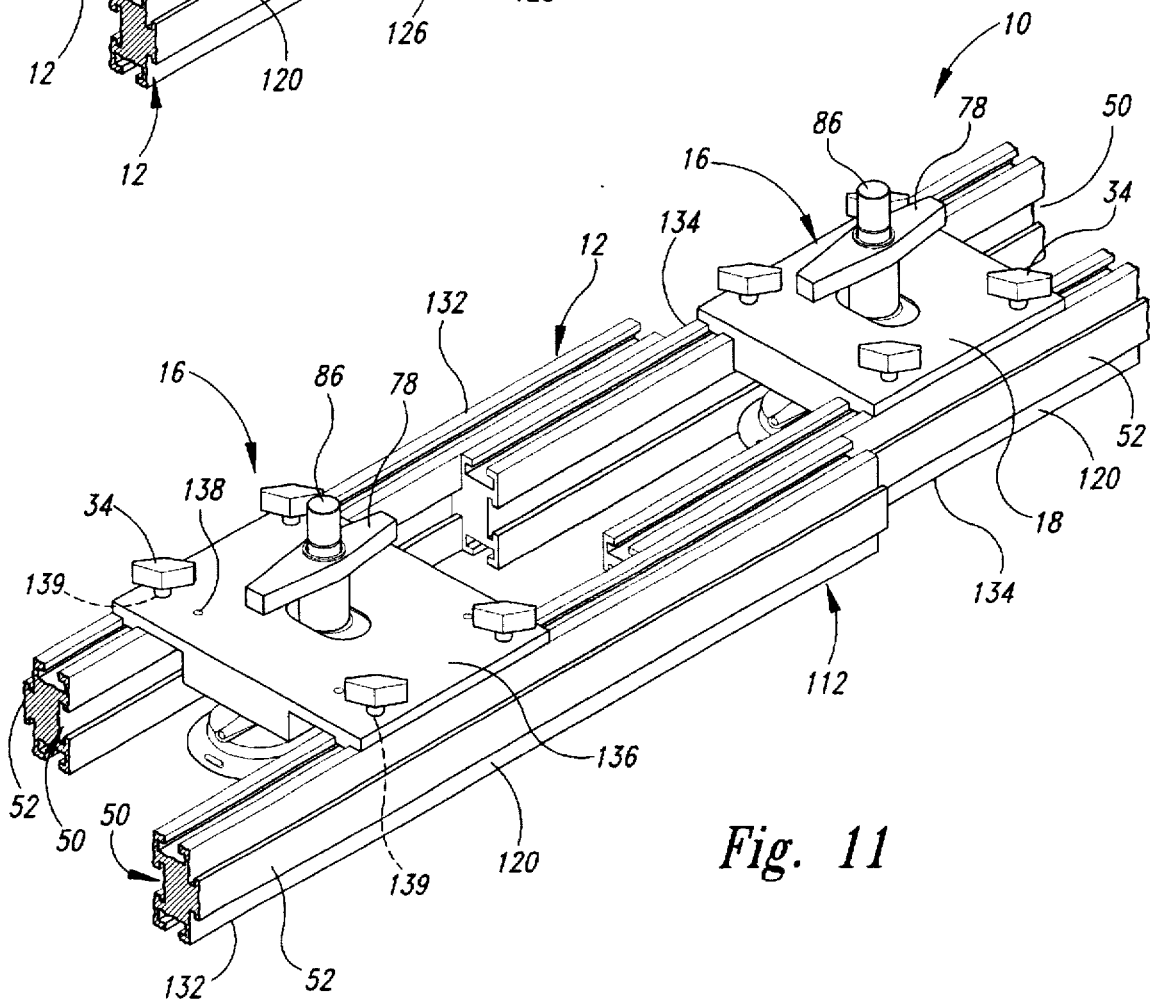
FIG. 11 is a fragmentary, isometric view of two vacuum tools of the present invention, each having a different frame rail spacing to allow the frame rails of one to be slidably interconnected with the frame rails of the other.

In alternate embodiments of the invention illustrated in FIGS. 10 and 11, each of the frame rails 12 of the vacuum tool 10 is formed by using two interconnected frame rails 120 to provide a frame rail with an increased length that can be adjusted to accommodate multiple workpieces, or workpieces having different lengths. Each frame rail 120 has an identical cross-sectional shape with the key member 52 and the keyways 50 thereof oriented as discussed above.

In the embodiment of FIG. 10, the frame rails 120 are positioned end-to-end to form a butt joint 122, such that the key member 52 of one frame rail is aligned with the key member 52 of the other frame rail to provide a substantially continuous key member. Similarly, the keyways 50 of the adjacent frame rails 120 are aligned to provide a substantially continuous keyway. A connecting rail 124 of identical construction to the frame rails 120 is removably connected to both of the endwise adjacent frame rails 120 in the same manner as described above for the stiffening members 110 of FIG. 9 to separably interconnect the frame rails. A keyway 126 of the connecting rail 124 is sized to slidably receive the key member 52 of the frame rail 120, and a key member 128 is sized to slide within the frame rail's keyway 50 if desired. The connecting rail 124 interconnects the two frame rails 120 forming one of the frame rail 12 of the vacuum tool 10 by sliding the connecting rail, with its keyway 126 receiving the key members 52 of the endwise adjacent frame rails 120, along the frame rails 120 until in a position that extends across the butt joint 122. In the preferred embodiment, the connecting rail 124 is positioned so the butt joint 122 is at approximately the middle of the connecting rail. Although the connecting rail 124 of the illustrated embodiment has the same cross-sectional shape as the frame rail 120, other connecting members can be used to releasably interconnect the frame rails 120.

The length of the frame rail 12 is determined by the number of frame rails 120 interconnected and secured together as described above using connecting rails 124. When the connecting rail 124 is connected to the frame rail 120, the connecting rail also serves to stiffen the frame rail in a manner similar to the stiffening members 110 discussed above.

In the embodiment of FIG. 11, the length of each frame rail 12 is formed by slidably interconnecting an outer frame rail 132 to an inner frame rail 134. The outer and inner frame rails 132 and 134 are interconnected by sliding the key member 52 of the inner frame rail 134 into the corresponding keyway 50 of the outer frame rail 132 and sliding the inner frame rail relative to the outer frame rail to form the frame rail 12 with the desired length. The length of the frame rail 12 is determined by the degree of overlap of the outer and inner frame rails 132 and 134 and the number of such frame rails interconnected to form the frame rail 12.

The vacuum cup assembly 16 attached to the inner frame rails 134 is constructed as discussed above. However, the vacuum cup assembly 16 attached to the outer frame rails 132 has a widened support plate 136 with a set of four inner fastener apertures 138 and a set of four outer fastener apertures 139. The outer fastener apertures 139 are positioned to receive the threaded shafts 40 of the fastening member 34 engaging the outer frame rails 132. The widened support plate 136 is designed to also be usable with the closer spaced inner frame rails 134 so the inner fastener apertures 138 are spaced the same as the fastener apertures 42 of the support plate 18.

Figure 12:
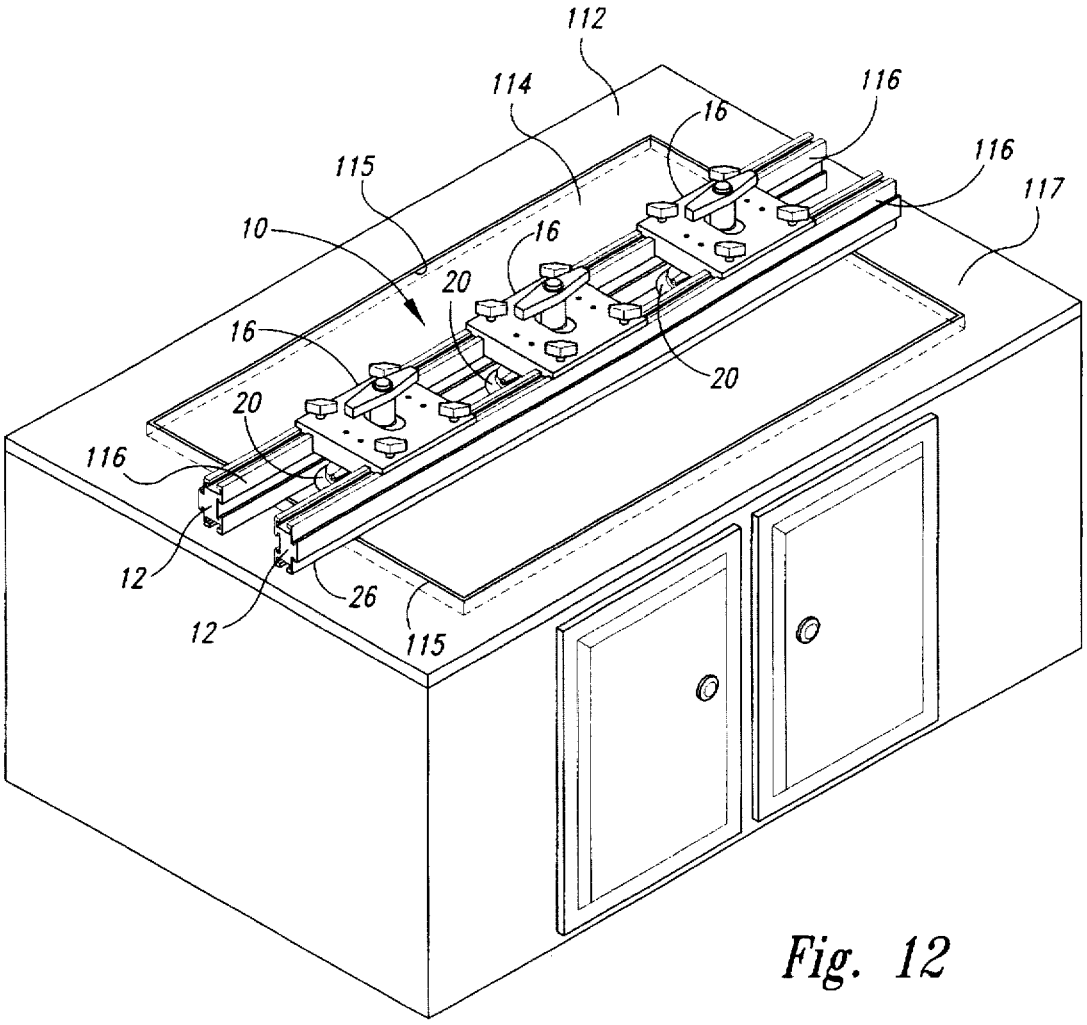
FIG. 12 is an isometric view of the vacuum tool of the present invention illustrated on a countertop with three vacuum cup assemblies retaining a cutout section of the countertop before removal from the countertop.

The portable vacuum tool 10 of the present invention, in addition to being adapted to secure one or more workpieces 28 against the frame rails 12 for carrying and installation, is usable for other useful purposes. It may be used to engage and retain one portion of a workpiece in a fixed position to prevent that portion from moving relative to another portion of the workpiece. As an example, the vacuum tool 10 is illustrated in FIG. 12 being used during a cutting operation wherein a middle portion 114 of a large marble or granite countertop slab 112 is being cut out to form an aperture 115 for a sink (not shown). A plurality of initial cuts are made in the countertop slab 112 to define the sides of the aperture 115, but the initial cuts are not yet interconnected so as to completely separate the middle portion 114 from a remainder portion 117 of the countertop slab 112 which will form the countertop once the middle portion 114 is removed. After making the initial cuts, the vacuum tool 10 is set onto the countertop slab 112 with the frame rails 12 spanning across the middle portion 114, and over the cuts already made on opposite sides of the middle portion. The outer end 116 of each of the frame rails 12 extend beyond the cuts onto the remainder portion 117 of countertop slab 112 to support the vacuum tool 10 over the aperture 115 being created. The vacuum cups 20 are moved into sealing contact with the middle portion 114, and suction is created between each vacuum cups and the middle portion. The vacuum cups 20 are then drawn upwardly to pull the bottom reference surface 26 of the frame rails 12 and the middle portion 114 into firm engagement.

When the vacuum tool 10 is installed and securely connected to the middle portion 114, the initial cuts are then extended and interconnected, typically at the corners of the aperture 115, thereby completely separating the middle portion 114 from the remainder portion 117 of the countertop slab 112. The vacuum tool 10 securely retains the middle portion 114 in place, with the entire weight of the middle portion being carried by the vacuum cups 20. The risk of uncontrolled breaking the countertop material, especially as the last portions of the cuts are made, is eliminated. Further, the danger of the middle portion 114 falling and injuring a worker or property as the last portions of the cuts are made is also eliminated. The vacuum tool 10 with middle portion 114 attached thereto are then lifted upwardly away from the remainder portion 117 of the countertop slab 112 as a unit and removed, thereby resulting in the aperture 115 formed in the countertop and ready for installation of the sink. It is noted that with the vacuum tool 10 the job of cutting the sink aperture 115 can be easily, quickly and safely accomplished by a single workman whereas a conventional cutting procedure requires one workman to cut the slab and one to hold the middle portion being cut in position until fully cut free.

The number of vacuum cup assemblies 16 used during the cutting procedure is selected such that the vacuum cups 20 collectively apply enough suction to carry the full weight of the middle portion 114 after being cut fully about its perimeter to separate the middle portion from the remainder portion 117 of the countertop slab 112. The frame rails 12 are selected with sufficient rigidity to prevent the frame rails from excessively flexing under the weight of the middle portion 114. If additional rigidity is desired, the stiffening members 110 discussed above can be connected to the frame rails.

Figure 13:
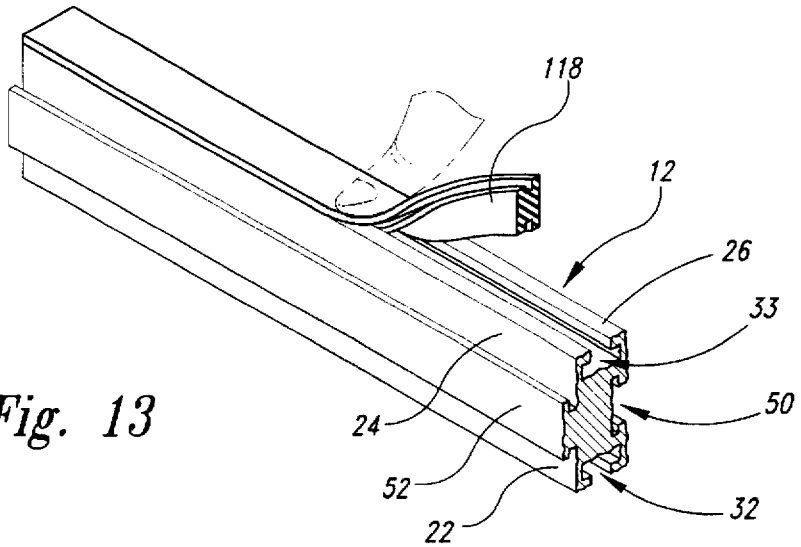
FIG. 13 is an enlarged, fragmentary isometric view of an inverted frame rail of FIG. 1 having a protective strip partially inserted into a bottom keyway of the frame rail.

As shown in FIG. 13, a protective strip 118 can be releasably inserted into the lower keyway 33 in the bottom portion 24 of the frame rail 12, shown in an inverted position in FIG. 13. The preferred protective strip 118 is a resilient rubber or other elastomeric material that is easily installed and removed. The protective strip 118 protects the workpiece 28, such as marble, granite, or the like from being scratched by the frame rails 12, for example during a cutting operation or while transporting the workpiece and the vacuum tool 10 as a unit to a selected remote destination. The outer face of the protective strip 118, when installed, serves as the bottom reference surface 26 of the frame rail 12.

Figure 14:
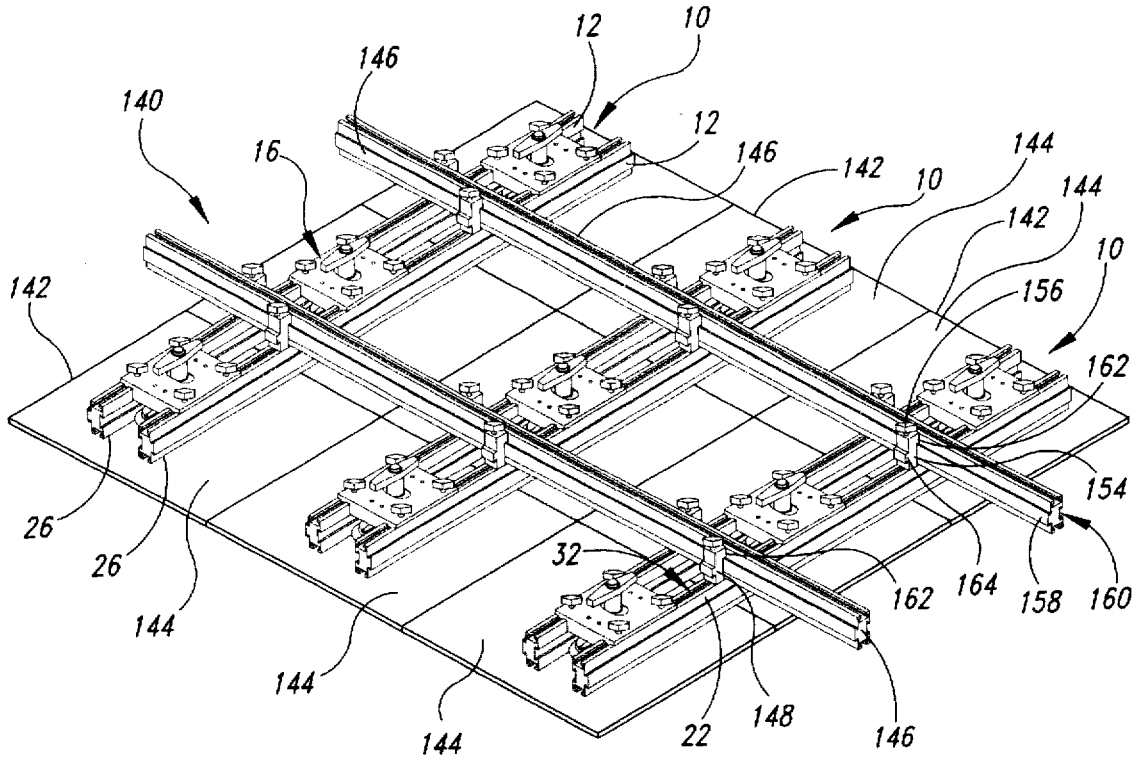
FIG. 14 is an isometric view of three vacuum tool of the present invention interconnected by two transverse bridging rails.

In FIG. 14, three vacuum tools 10 are shown arranged with their frame rails 12 in parallel alignment. The three vacuum tools 10 are separably interconnected to define an array 140 of nine vacuum cup assemblies. Each of the vacuum cup assemblies 16 of each vacuum tool 10 is securely connected to one of nine tiles 142, or other workpiece illustrated in FIG. 14, with the flat top surfaces 144 of the tiles 142 being in coplanar engagement with the bottom reference surfaces 26 of the frame rails 12. Accordingly, the array 140 of vacuum cup assemblies 16 simultaneously and securely hold nine tiles 142 together with the top surfaces 144 of all of the tiles being substantially coplanar.

The frame rails 12 of the vacuum tools 10 are releasably interconnected by a pair of bridging members 146 extending transversely over the frame rails. Each of the bridging members 146 has a cross section that is the same size and shape as the cross section of the frame rails 12, and themselves can also serve as elongated frame rails when not in use as bridging members. Each bridging member has a longitudinally extending key member 158 along one side of thereof and a longitudinally extending keyway 160 opposite the key member on the other side thereof.

Figure 15:
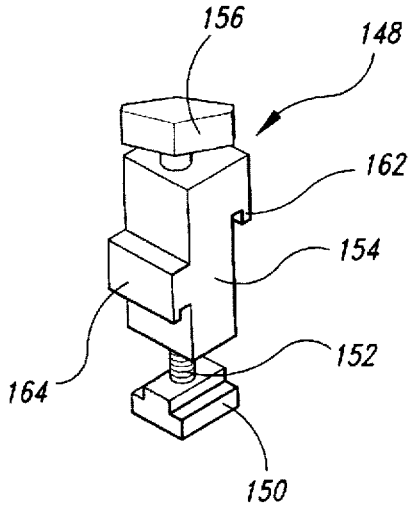
FIG. 15 is an enlarged isometric view of a connecting member of FIG. 14 used to connect the bridging rails to the frame rails.

The bridging members 146 are securely but releasably connected to the frame rails 12 of each vacuum tool 10 by a pair of connectors 148. Each of the connectors 148 has a generally T-shaped nut 150 best seen in FIG. 15. The T-shaped nut 150 is slidably received in the upper keyway 32 of one of the frame rails 12. As best seen in FIG. 15, a threaded shaft 152 threadably engages the T-shaped nut 150 and extends upwardly and fully through a smooth bore aperture in a double-hooked body 154 and projects thereabove and is threadably engaged by a winged top cap nut 156. When the top cap nut 156 is screwed down onto the threaded shaft 152, the T-shaped nut 150 and the double-hooked body 154 are pulled into firm engagement with the top portion 22 of the frame rail 12 to which connected.

As best seen in FIGS. 14 and 15, the double-hooked body 154 has an upper hook 162 that is shaped to hook onto the top of the key member 158 of the bridging member 146 and exert a downward force on the key member so as to securely clamp the bridging member against the top portion 22 of the frame rail 12. Accordingly, the upper hook 162 prevents the bridging member 146 from moving vertically or longitudinally relative from the frame rail 12. When the top cap nut 156 of the connector 148 is loosened, the downward force from the upper hook onto the key member 158 is reduced to allow the bridging member's longitudinal position to be adjusted relative to the frame rails 12.

The double-hooked body 154 also has a lower hook 164 on a side of the double-hooked body opposite the upper hook 162. The lower hook 164 is shaped and sized to hook into the keyway 160 of the bridging member 146, and to exert a downward force on the bridging member when the cap nut 156 is tightened, thereby securely clamping the bridging member 146 to the frame rails 12 against vertical or longitudinal movement. Loosening the top cap nut 156 reduces the downward force from the lower hook onto the keyway to allow longitudinal movement of the connector 148. In the illustrated embodiment of FIG. 14, each bridging member 146 is securely connected to each frame rail 12 of each vacuum tool 10 by a pair of connectors 148 to prevent movement of the frame rails relative to the bridging members. One of the frame rails 12 is clamped using the upper hook 162 of one connector 148 and the other frame rail is clamped using the lower hook 164 of another connector.

The bridging members 146 provide lateral strength to retain the adjacent pairs of frame rails together in precise spacing and with the bottom reference surfaces 26 of the adjacent pairs of frame rails in coplanar relation, thereby securely holding the array of nine vacuum cup assemblies 16 and nine tiles 142 together in coplanar relation. The array of tile can then be transported to a selected installation area and set down as a unit onto a layer of fast drying adhesive to form an entire countertop as a unit, thereby resulting in a fixed array of workpieces all having coplanar top surfaces 144.

Several embodiments of the portable leveling vacuum tool have been disclosed herein for illustrative purposes. Numerous modifications and variations to the portable leveling vacuum tool will occur to those skilled in the art in view of this disclosure. Therefore, it is to be understood that such modifications and variations can be practiced while remaining within the spirit and scope of the invention as defined by the following claims.

We claim:

1. A portable leveling vacuum tool for use with a plurality of workpieces having at least a predetermined width to align substantially flat top surfaces of the workpieces in a coplanar orientation, comprising:

a pair of elongated frame rails positionable in spaced-apart parallel relation to each other, each of said frame rails having an elongated bottom surface, said bottom surfaces of said frame rails being spaced apart in a coplanar relation by less than the predetermined workpiece width for engagement of each of said bottom surfaces with the top surface of each of the workpieces to position the top surfaces of the workpieces in coplanar relation, said frame rails are sufficiently flexible to conform to the general curvature of a nonplanar work surface; and a plurality of vacuum cup assemblies mounted to said frame rails, at least one of said vacuum cup assemblies being adjustably movable along the length of said frame rails and lockable in a selected longitudinal position to prevent movement of said movable vacuum cup assembly along said frame rails during use of the vacuum tool, each of said vacuum cup assemblies including a support body spanning between and attached to each of said frame rails and a vacuum cup supported by said support body in position between said frame rails for engagement with the top surface of one of the workpieces, said vacuum cup being adjustably movable toward the support body and between said frame rails sufficiently to position the top surface of the one of the workpieces that the vacuum cup is engaging substantially coplanar with said bottom surfaces of said frame rails to hold the top surface of the workpiece against said frame rail bottom surfaces.

2. The portable leveling vacuum tool of claim 1 wherein each of said vacuum cups is adjustably movable away from said support body providing support thereto toward one of the workpieces to be engaged thereby.

3. The portable leveling vacuum tool of claim 1 wherein each of said vacuum cup assemblies has said vacuum cup thereof mounted on a movable threaded body and a handle threaded on said body for selective movement of said body and said vacuum cup therewith toward and away from the workpiece upon rotation of said handle.

4. The portable leveling vacuum tool of claim 1 wherein at least one of said frame rails has a longitudinally extending alignment channel therein, and each of said vacuum cup assemblies further includes a retaining member slidably positioned in said alignment channel and selectively operable to releasably secure said support body in said selected longitudinal position along said frame rails.

5. A portable leveling vacuum tool for use with a plurality of workpieces having at least a predetermined width to align substantially flat top surfaces of the workpieces in a coplanar orientation, comprising:

a pair of elongated frame rails positionable in spaced-apart parallel relation to each other, each of said frame rails having an elongated bottom surface, said bottom surfaces of said frame rails being spaced apart in a coplanar relation by less than the predetermined workpiece width for engagement of each of said bottom surfaces with the top surface of each of the workpieces to position the top surfaces of the workpieces in coplanar relation; and a plurality of vacuum cup assemblies mounted to said frame rails, at least one of said vacuum cup assemblies being adjustably movable along the length of said frame rails and lockable in a selected longitudinal position to prevent movement of said movable vacuum cup assembly along said frame rails during use of the vacuum tool, each of said vacuum cup assemblies including a support body spanning between and attached to each of said frame rails and a vacuum cup supported by said support body in position between said frame rails for engagement with the top surface of one of the workpieces, said vacuum cup being adjustably movable toward the support body and between said frame rails sufficiently to position the top surface of the one of the workpieces that the vacuum cup is engaging substantially coplanar with said bottom surfaces of said frame rails to hold the top surface of the workpiece against said frame rail bottom surfaces, each of said vacuum cup assemblies further includes a vacuum pump attached to said support body and connected at one end to said vacuum cup thereof and having an opposite threaded end, and a handle threadably received on said vacuum pump threaded end, said handle being rotatable to move said vacuum pump and said vacuum cup connected thereto toward and away from the workpiece, said vacuum pump being operable to apply a vacuum between said vacuum cup and the workpiece engaged thereby.

6. The portable leveling vacuum tool of claim 5 wherein said vacuum pump includes a plunger operable to apply said vacuum between said vacuum cup and the workpieces engaged thereby, said plunger having indicia thereon to indicate when said vacuum is created sufficient to support the weight of the workpiece.

7. The portable leveling vacuum tool of claim 1 wherein said support body is removably attached to said frame rails for selective separation therefrom.

8. The portable leveling vacuum tool of claim 1 wherein each of said frame rails is comprised of a plurality of interconnected axially extending frame rail sections.

9. The portable leveling vacuum tool of claim 8 wherein said frame rail sections forming each of said frame rails are interconnected in an end-to-end coaxial configuration, adjacent ones of said frame rail sections being connected together by a connecting member.

10. A portable leveling vacuum tool for use with a plurality of workpieces having at least a predetermined width to align substantially flat top surfaces of the workpieces in a coplanar orientation, comprising:

a pair of elongated frame rails positional in spaced-apart parallel relation to each other, each of said frame rails having a substantially flat, elongated bottom surface, said bottom surfaces of said frame rails being spaced apart in a coplanar relation by less that the predetermined workpeice width for engagement of each of said bottom surfaces with the top surface of each of the workpieces to position the top surfaces of the workpieces in coplanar relation, each of said frame rails being comprised of a plurality of interconnected axially extending frame rail sections, said frame rail sections forming each of said frame rails including an inner frame rail section and an outer frame rail section spaced outward of said inner frame rail section, said inner and outer frame rail sections being interconnected; and a plurality of vacuum cup assemblies mounted to said frame rails, at least one of said vacuum cup assemblies being adjustably movable along the length of said frame rails and lockable in a selected longitudinal position to prevent movement of said movable vacuum cup assembly along said frame rails during use of the vacuum tool, each of said vacuum cup assemblies including a support body spanning between and attached to each of said frame rails and a vacuum cup supported by said support body in position between said frame rails for engagement with the top surface of one of the workpieces, said vacuum cup being adjustably movable toward the support body and between said frame rails sufficiently to position the top surface of the one of the workpieces that the vacuum cup is engaging substantially coplanar with said bottom surfaces of said frame rails to hold the top surface of the workpiece against said frame rail bottom surfaces.

11. The portable leveling vacuum tool of claim 1, further including a stiffening member removably attachable to and supporting one of said frame rails to inhibit flexing of said one frame rail to which the stiffening member is attached.

12. The portable leveling vacuum tool of claim 1 wherein one of said stiffening member or said one frame rail has a key member thereon and the other of said stiffening member or said one frame rail has a keyway sized and positioned to slidably receive said key member therein to retain said stiffening member adjacent to said one frame rail.

13. The portable leveling vacuum tool of claim 1, further including a second pair of elongated frame rails and a second plurality of vacuum cup assemblies mounted thereto as set forth in claim 1, said first and second pairs of frame rails being arranged substantially parallel to the other, the vacuum tool further including a bridge member removably interconnecting said first and second pairs of frame rails to hold said bottom surfaces of said first and second pairs of frame rails in coplanar relation.

14. A portable vacuum tool for use with a workpiece having a predetermined width and a substantially flat top surface, comprising:

a pair of elongated frame rails positionable in spaced-apart parallel relation to each other, each of said frame rails having engagement portions arranged in coplanar relation with each other and with the engagement portions of the other frame rail, said engagement portions of said frame rails being spaced apart by less than the predetermined workpiece width for engagement of said engagement portions with the top surface of the workpiece to position the top surface of the workpiece in coplanar relation with said engagement portions; and a vacuum cup assembly mounted to said frame rails, said vacuum cup assembly including a support body spanning between and attached to each of said frame rails and a vacuum cup supported by said support body in position between said frame rails for engagement with the top surface of the workpiece, said vacuum cup being adjustably movable toward the support body and between said frame rails sufficiently to position the top surface of the workpiece substantially coplanar with said engagement portions of said frame rails to hold the top surface of the workpiece against said frame rail engagement portions, said vacuum cup assembly further includes a vacuum pump attached to said support body and connected at one end to said vacuum cup and having an opposite threaded end, and a handle threadably received on said vacuum pump threaded end, said handle being rotatable to move said vacuum pump and said vacuum cup connected thereto toward said support body, said vacuum pump being operable to apply a vacuum between said vacuum cup and the workpiece.

15. The portable vacuum tool of claim 14 wherein said vacuum cup is adjustably movable away from said support body and toward the workpiece.

16. The portable vacuum tool of claim 14 wherein said vacuum pump is a manual pump.

17. The portable vacuum tool of claim 14 wherein said vacuum cup assembly includes adjustable fasteners connecting said support body to each of said frame rails to allow selected longitudinal movement thereof along said frame rails, said fasteners being selectively operable to securely lock said support body in said selected longitudinal position to prevent movement along said frame rails.

18. The portable vacuum tool of claim 14 wherein said vacuum cup assembly is adjustably movable along the length of said frame rails, and at least one of said frame rails has a longitudinally extending alignment channel therein, and said vacuum cup assembly further includes a retaining member slidably positioned in said alignment channel and selectively operable to releasably secure said support body in said selected longitudinal position along said frame rails.

19. The portable vacuum tool of claim 14 wherein said support body is removably attached to said frame rails for selective separation therefrom.

20. The portable vacuum tool of claim 14 wherein each of said frame rails is comprised of a plurality of interconnected axially extending frame rail sections.

21. The portable vacuum tool of claim 20 wherein said frame rail sections forming each of said frame rails are interconnected in an end-to-end coaxial configuration, adjacent ones of said frame rail sections being connected together by a connecting member.

22. A portable vacuum tool for use with a workpiece having a predetermined width and a substantially flat top surface, comprising:

a pair of elongated frame rails positionable in spaced-apart parallel relation to each other, each of said frame rails having engagement portions arranged in coplanar relation with each other and with the engagement portions of the other frame rail, said engagement portions of said frame rails being spaced apart by less than the predetermined workpiece width for engagement of said engagement portions with the top surface of the workpiece to position the top surface of the workpiece in coplanar relation with said engagement portions, each of said frame rails is comprised of a plurality of interconnected axially extending frame rail sections, said frame rail sections forming each of said frame rails includes an inner frame rail section and an outer frame rail section spaced outward of said inner frame rail section, said inner and outer flame rail sections being interconnected; and a vacuum cup assembly mounted to said frame rails, said vacuum cup assembly including a support body spanning between and attached to each of said frame rails and a vacuum cup supported by said support body in position between said frame rails for engagement with the top surface of the workpiece, said vacuum cup being adjustably movable toward the support body and between said frame rails sufficiently to position the top surface of the workpiece substantially coplanar with said engagement portions of said frame rails to hold the top surface of the workpiece against said frame rail engagement portions.

23. A portable vacuum tool for use with a workpiece having a predetermined width and a substantially flat top surface, comprising:

a pair of elongated frame rails positionable in spaced-apart parallel relation to each other, each of said frame rails having engagement portions arranged in coplanar relation with each other and with the engagement portions of the other frame rail, said engagement portions of said frame rails being spaced apart by less than the predetermined workpiece width for engagement of said engagement portions with the top surface of the workpiece to position the top surface of the workpiece in coplanar relation with said engagement portions;

a vacuum cup assembly mounted to said frame rails, said vacuum cup assembly including a support body spanning between and attached to each of said frame rails and a vacuum cup supported by said support body in position between said frame rails for engagement with the top surface of the workpiece, said vacuum cup being adjustably movable toward the support body and between said frame rails sufficiently position the top surface of the workpiece substantially coplanar with said engagement portions of said frame rails to hold the top surface of the workpiece against said frame rail engagement portions; and a stiffening member removably attachable to and supporting one of said frame rails to inhibit flexing of said one frame rail to which the stiffening member is attached.

24. The portable vacuum tool of claim 23 wherein said one frame rail has one of a key member and a keyway thereon and said stiffening member has the other of said key member or said keyway, said keyway slidably receiving said key member to retain said stiffening member adjacent to said one frame rail.

25. The portable vacuum tool of claim 14, further including a second pair of elongated frame rails and a second vacuum cup assembly mounted thereto as set forth in claim 14, said first and second pairs of frame rails being arranged substantially parallel to the other, each frame rail of said second pair of frame rails has engagement portions arranged in coplanar relation with each other and with the engagement portions of the other frame rail of said second pair of frame rails, the vacuum tool further including a bridge member removably interconnecting said first and second pairs of frame rails to hold said engagement portions of said first and second pairs of frame rails in coplanar relation.

26. The portable vacuum tool of claim 14 wherein said support body is a plate extending between said frame rails and mounted to said frame rails by releasable fasteners.

27. A portable vacuum tool for use with a workpiece having a predetermined width and a substantially flat top surface, comprising:

a pair of elongated frame rails positionable in spaced-apart parallel relation to each other, each of said frame rails having engagement portions arranged in coplanar relation with each other and with the engagement portions of the other frame rail, said engagement portions of said frame rails being spaced apart by less than the predetermined workpiece width for engagement of said engagement portions with the top surface of the workpiece to position the top surface of the workpiece in coplanar relation with said engagement portions; and a vacuum cup assembly mounted to said frame rails, said vacuum cup assembly including a support body spanning between and attached to each of said frame rails and a vacuum cup supported by said support body in position between said frame rails for engagement with the top surface of the workpiece, said vacuum cup being adjustably movable toward the support body and between said frame rails sufficiently to position the top surface of the workpiece substantially coplanar with said engagement portions of said frame rails to hold the top surface of the workpiece against said frame rail engagement portions, said support body being a plate extending between said frame rails and mounted to said frame rails by releasable fasteners, said plate includes an aperture and wherein said vacuum cup assembly includes a vacuum pump operative to generate a vacuum between said vacuum cup and the workpiece, said vacuum pump having an elongated body extending through said aperture and longitudinally movable therein with said vacuum cup attached to a lower end portion of said body and an upper end portion of said body being threaded, said vacuum cup assembly further including a threaded handle rotatably mounted on said body threaded upper end portion to selectively move said body and said vacuum cup attached to said body lower end portion toward said support body.

28. The portable vacuum tool of claim 27 wherein said aperture is an elongated slot in said plate having a length oriented to extend in a direction transverse to said frame rails, said body being disposed in said slot for movement along said slot length to selectively laterally position said body and said vacuum cup attached to said body lower end portion relative to said frame rails.

29. The portable vacuum tool of claim 14 wherein each of said engagement portions has a substantially flat engagement surface in coplanar relation with the engagement surfaces of the other engagement portions.

30. The portable vacuum tool of claim 14 wherein said engagement portions of each frame rail are interconnected and define a continuous bottom engagement surface coplanar with the bottom engagement surface of the other frame rail.

* * * * *